US006646367B2

(12) United States Patent
Makhov

(10) Patent No.: US 6,646,367 B2
(45) Date of Patent: Nov. 11, 2003

(54) FIELD EMITTER FOR MICROWAVE DEVICES AND THE METHOD OF ITS PRODUCTION

(75) Inventor: Vladimir Makhov, Williamsport, PA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 10/216,249

(22) Filed: Aug. 12, 2002

(65) Prior Publication Data

US 2002/0193038 A1 Dec. 19, 2002

Related U.S. Application Data

(62) Division of application No. 09/580,178, filed on May 26, 2000, now Pat. No. 6,485,346.

(51) Int. Cl.[7] ..... H01J 1/62

(52) U.S. Cl. ..... 313/310; 313/311; 313/495; 313/326; 445/24

(58) Field of Search ..... 313/495, 309, 313/336, 351, 310, 311, 326, 103 R; 445/24, 25, 50, 51

(56) References Cited

U.S. PATENT DOCUMENTS

| | | | |
|---|---|---|---|
| 2,412,824 | A | 12/1946 | McArthur |
| 2,437,240 | A | 3/1948 | Brown |
| 2,826,719 | A | 3/1958 | Donal, Jr. |
| 2,928,987 | A | 3/1960 | Peters, Jr. |
| 3,121,822 | A | 2/1964 | Boyd |
| 3,297,901 | A | 1/1967 | MacDonald et al. |
| 3,646,388 | A | 2/1972 | Dudley et al. |
| 3,896,332 | A | 7/1975 | Heathcote |
| 3,899,714 | A | 8/1975 | Esterson et al. |
| 3,988,636 | A | 10/1976 | Sato et al. |
| 5,280,218 | A | 1/1994 | Smith |
| 5,348,934 | A | 9/1994 | Shaw |
| 5,382,867 | A | 1/1995 | Yuji et al. |
| 5,463,271 | A | 10/1995 | Geis et al. |
| 6,005,347 | A | 12/1999 | Lee |

FOREIGN PATENT DOCUMENTS

| | | |
|---|---|---|
| GB | 2317741 | 12/1996 |
| GB | 2 308 224 | 6/1997 |
| RU | 98715 | 9/1976 |
| RU | 2040821 | 4/1991 |
| RU | 2071136 | 5/1992 |
| RU | 2051439 | 1/1993 |
| RU | 2115193 | 3/1994 |
| WO | WO95/26039 | 3/1995 |

*Primary Examiner*—Vip Patel
*Assistant Examiner*—Joseph Williams
(74) *Attorney, Agent, or Firm*—Lowe Hauptman Gilman & Berner, LLP

(57) ABSTRACT

The present invention relates to electronics and particularly to field emitters used in M-type microwave devices. The design of a multi-layer field emitter is proposed which has at least one operating film and supporting films, providing mechanical strength and preventing penetration of corrosion materials into the operating film at high operating temperatures. The supporting films could be produced from the same material or material with linear expansion coefficients equal or close to that of the operating film material. Built-in mechanical stress can cause not only deformation but also a break of the film during its exploitation in a wide range of temperatures. In the inventive structure the thermal stresses in the operating film during an emission from its surface are lower due to good thermal contact with supporting films.

3 Claims, 5 Drawing Sheets

FIELD EMITTER FOR MICROWAVE DEVICES AND THE METHOD OF ITS PRODUCTION

This application is a division of application Ser. No. 09/580,178, filed May 26, 2000, now U.S. Pat. No. 6,485, 346.

RELATED APPLICATIONS

The present application is related to co-pending U.S. patent application Ser. No. 09/380,247, entitled "M-TYPE MICROWAVE DEVICE", filed Aug. 30, 1999 and U.S. patent application Ser. No. 09/380,248, entitled "MAGNETRON", filed Aug. 30, 1999, both of which are hereby incorporated by reference into this specification in their entirety.

FIELD OF THE INVENTION

The present invention relates generally to the field of electronics, and more particularly, to field emitters used in M-type microwave devices.

BACKGROUND OF THE INVENTION

Well known are microwave devices such as that disclosed in Russian Patent No. 2007777, which have field emission cathodes having interfaces for the purpose of preventing of thermal diffusion of corrosively active materials. These interfaces are shaped as discs made of material which are placed on both sides of a field emitter operating film made of foil having a thickness of 0.5 to 5$\mu$. The discs have a greater thickness than the foil. One of the drawbacks of Russian Patent '777 is the inability to control the thickness of the foil used as the field emitter. It is essentially impossible to assemble such an emitter at a definite thickness of the foil. Besides, non-uniform thermal contact between the operating film and protective discs along the circumference does not allow heat to be effectively carried off from the field emitter during its operation. This may lead to damage of the field emitter because of overheating and melting.

Other types of microwave devices are also known such as that disclosed in Russian Patent No. 1780444 where a two-layer structure, consisting of the field emitter operating film applied on a foil substrate, is used as a field emitter. The basic drawback of the Russian Patent '444 is that one side of the operating film is not protected from mechanical and diffusion processes both during the assembly and the operation of the device. Such exposure reduces the film's mechanical strength and reliability as well as the lifetime of the whole field emitter.

SUMMARY OF THE INVENTION

These deficiencies in the prior art are addressed by the present invention.

The present invention relates to electronics and particularly to field emitters used in M-type microwave devices. The design of a multi-layer field emitter is proposed which has at least one operating film and supporting films, providing mechanical strength and preventing penetration of corrosive materials into the operating film at high operating temperatures. The supporting films could be produced from the same material or material with linear expansion coefficients equal or close to that of the operating film material. Built-in mechanical stress can cause not only deformation but also breakage of the film when exposed to a wide range of temperatures. In the inventive structure thermal stresses in the operating film during an emission from its surface are lower due to good thermal contact with supporting films.

General advantages of the field emitter of the present invention compared to the prior art is that the present invention is mechanically stronger and more reliable which makes the cathode assembly easier. The present invention has a minimum of mechanical tensions which provides safe operation in a wide temperature range. The present invention provides operation while in contact with corrosively active materials under high temperature.

The operating film of a field emitter in accordance with the present invention could be as thin as a few angstroms which permits this design to be used in a variety of devices. Additionally, the supporting films have a direct contact with the operating film, thus carrying off heat effectively from the emitter during its operation.

Production of the field emitters may be based on well developed technological processes currently used in mass production of thin film circuits and allowing the production of inexpensive mono- and multi-emitter systems.

In accordance with an aspect of the present invention, a method of manufacturing a field emitter for a magnetron is described. The method includes depositing three layers of film on a substrate. At least one protective mask is placed on an uppermost layer of the three layers. The three layers not protected by the at least one protective mask are first removed. Horizontal and vertical portions of the first and third layers of the remaining three layers are exposed. Oopposite edges of the first and third layers are removed. The at least one protective mask and the substrate are removed leaving at least one field emitter.

In accordance with another aspect of the present invention, a field emitter for a magnetron is described. The field emitter includes a central operating layer having a first edge and a second edge and a first surface and a second surface. At least one first support layer is on the first surface. The first edge and the second edge extend beyond the first support layer and the second support layer.

In accordance with another aspect of the present invention, a method of manufacturing a field emitter for a magnetron is described. The method includes depositing three layers of film on a substrate. At least one protective mask is placed on an uppermost layer of the three layers. Portions of the three layers not protected by the at least one protective mask are removed to form a plurality of stacks of layers of film and to expose an upper surface of the substrate therebetween. A fourth layer of film is deposited onto an upper surface of the at least one protective mask and on the exposed upper surface of the substrate. The layers of film and protective mask are removed above the partially etched layer. A portion on the second layer of film is partially removed to expose a portion of the upper surface of the second layer. A fifth layer of film is deposited on the remaining partially etched layer, the portions of the upper surface of the second layer, and an upper surface of the additional layer; removing the partially etched layer and the layer of film above the partially etched layer; depositing a sixth layer on the upper surface of the first layer and on a portion of the fourth layer; depositing a seventh layer of film on an upper surface of the sixth layer of film; and removing all layers except for the fourth layer, the fifth layer and the seventh layer.

Still other aspects of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

The geometrical dimensions and the shapes of all of the herein described arrangements of field emitters depend on particular applications and usually are determined by geometrical and operating characteristics of devices. However, regardless of device characteristics, the typical thickness of an operating film is between 0.0001 and 10 $\mu$m and the typical thickness of supporting films is between 1 and 100 $\mu$m.

Figure 1:
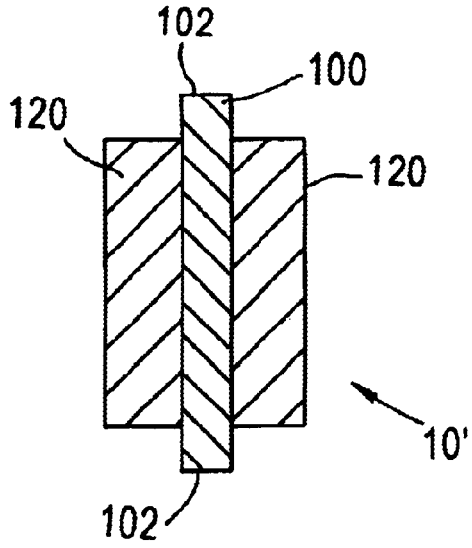
FIG. 1 is a cross-sectional view of the field emitter including operating film and side supporting films made of different material.
Figure 2:
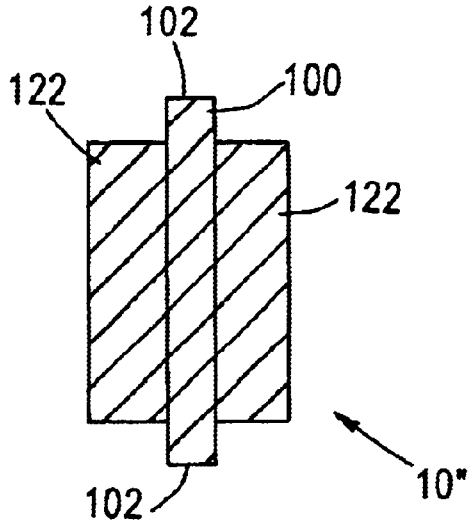
FIG. 2 is a cross-sectional view of a field emitter similar to FIG. 1 except that the operating film and the side supporting films are made of the same material.
Figure 3:
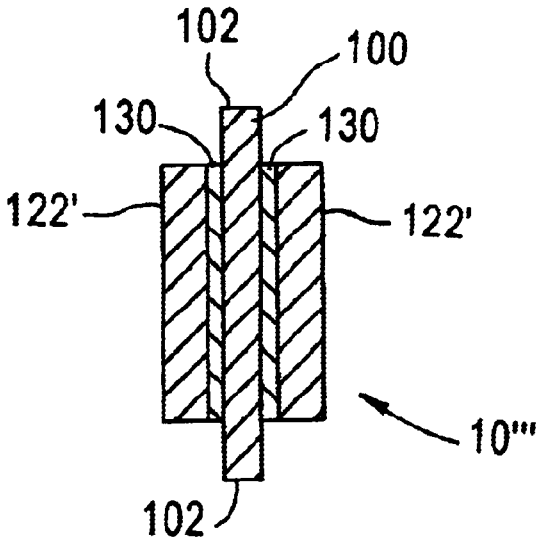
FIG. 3 is a cross-sectional view of the field emitter having the operating film side supporting films and an interface film with an intermediate expansion coefficient.
Figure 4:
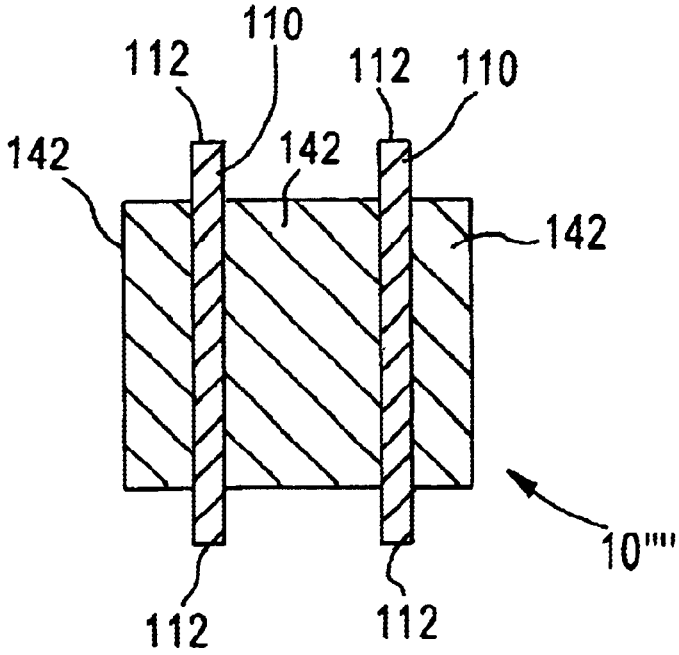
FIG. 4 is a cross-sectional view of a multi-film field emitter having operating films and supporting films.

As depicted in FIGS. 1–4, a field emitter 10', 10", 10''', 10"" includes an operating film (100 in FIGS. 1–3 and 110 in FIG. 4). Operating films 100, 110 have ends (102 in FIGS. 1–3 and 112 in FIG. 4), respectively, each of which protrudes beyond the surface of supporting films (120, 122, 122' in FIGS. 1–3 and 142 in FIG. 4). The supporting films 120, 122, 122' and 142 are on opposite surfaces of the operating films 100, 110. In the FIG. 3 embodiment, the supporting films 120, 122, 122', 142 may have a coefficient of linear expansion the same or close to that of the operating film 100, 110. The supporting films 120, 122, 122', 142 permit use of the field emitter 10', 10", 10''', 10"" in a wide range of temperatures while maintaining its geometry and dissipating heat from the operating film 100, 110 more effectively. The supporting films 120, 122, 122', 142 also prevent a thermal diffusion of corrosively active materials contacting with the emitter 10', 10", 10''', 10"".

As depicted in FIG. 3, an interface film 130 is located opposite of the surfaces operating film 100 between the operating film 100 and the supporting films 122'. Each of the interface films 130 is co-extensive with the supporting films 122'.

Field emitters for microwave devices operate in the following way as described and depicted in patent application Ser. Nos. 09/380,247 and 09/380,248. A positive potential is applied to the anode of the device. A negative potential is applied to the field emitter. When a potential between the anode and the cathode reaches a certain value, the field emitter starts to emit electrons, into an interaction space between the cathode and the anode. As described and illustrated herein, FIGS. 1–4 show completed structures and FIGS. 5 and 6 show the method of production of the field emitters of FIGS. 1–4. FIG. 5*e* corresponds to FIG. 1 and FIG. 6*i* corresponds to FIG. 2.

Figure 5A:
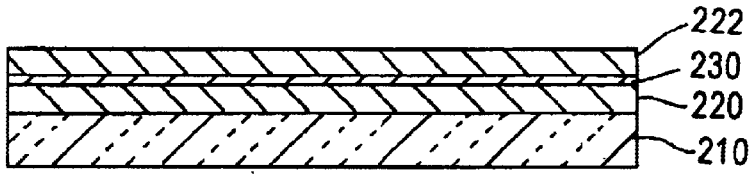
FIGS. 5*a*–5*e* are illustrations of a first series of depositing and etching processes used in forming field emitters according to the present invention.
Figure 5B:
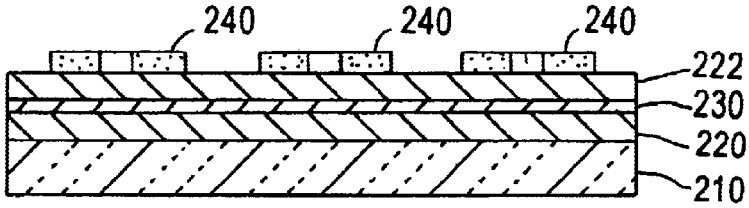
Figure 5C:
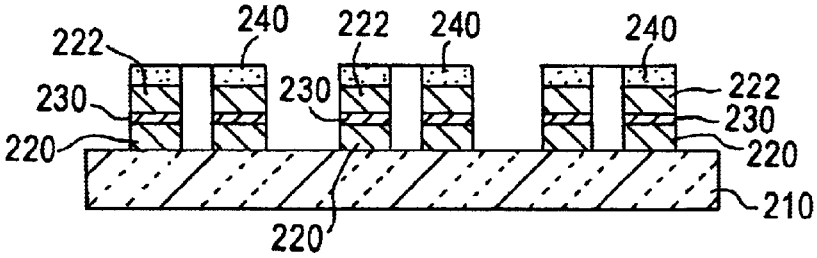
Figure 5D:
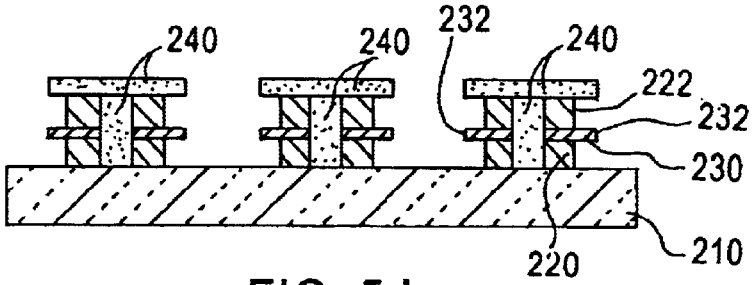
Figure 5E:
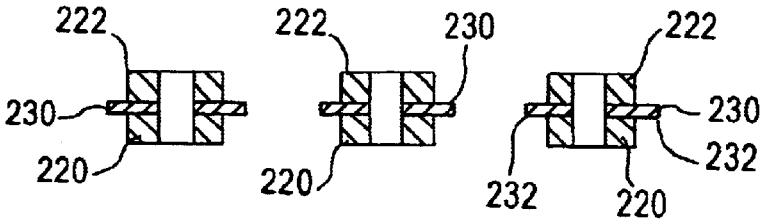

One method of manufacturing a field emitter according to the present invention is depicted in FIGS. 5*a*–5*e*. A film 220 of material with an expansion co-efficient close to that of an operating film 230 and the operating film 230 itself are deposited sequentially using vacuum deposition on a substrate 210 in a vacuum chamber. Without opening of the vacuum chamber, a film 222 of the same material as the film 220 is deposited onto the operating film 230. In FIG. 5*b*, a protective mask or photoresist 240 protecting the films (222, 230, 220) underneath from etching is deposited on the film structure. In FIG. 5*c*, the etching of the structure down to the substrate 210 is performed by ion-beam etching. In FIG. 5*d*, to form the operating structure of the end of the field emitter, exposed vertical and horizontal areas are protected by the photoresist 240 in such a way that only an operating edge 232 of the film 230 of the field emitter is not protected. The etching of the films 222, 220 by selective etching down to a defined level is then performed as shown in FIG. 5*d*. The photoresist 240 is removed from the formed structure and the structure itself is detached from the substrate 210 as depicted in FIG. 5*e*. The materials which may be used are as follows: substrate 210 may be aluminum, the films 220 and 222 may be vanadium, and the film 230 may be tantalum.

Figure 6A:
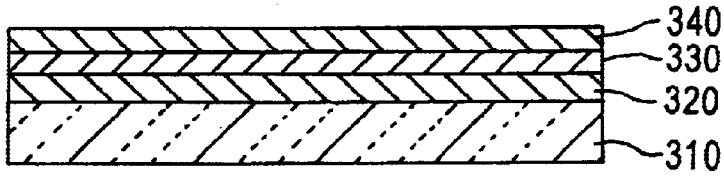
FIGS. 6*a*–6*i* are illustrations of a second series of depositing and etching processes used in forming field emitters according to the present invention.
Figure 6B:
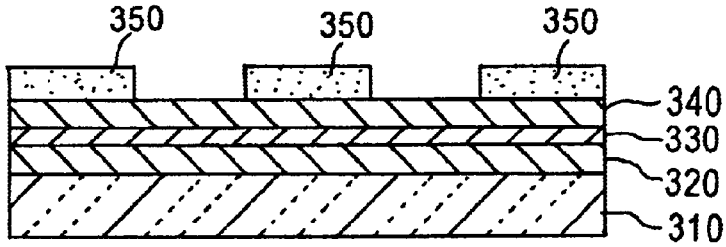
Figure 6C:
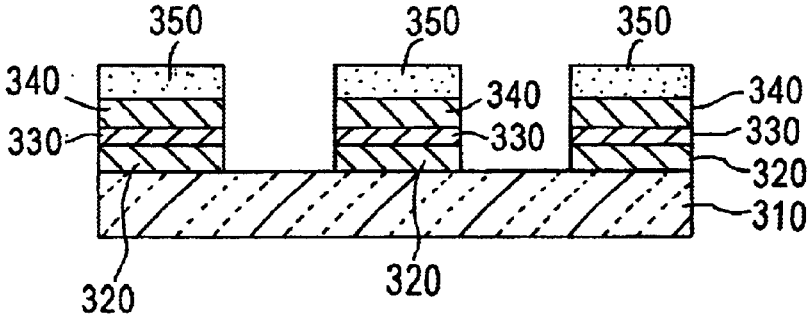
Figure 6D:
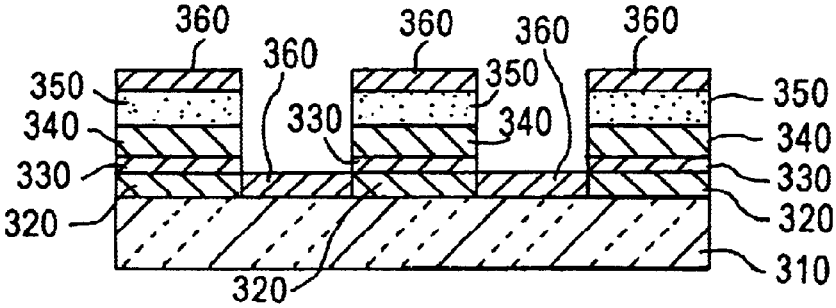
Figure 6E:
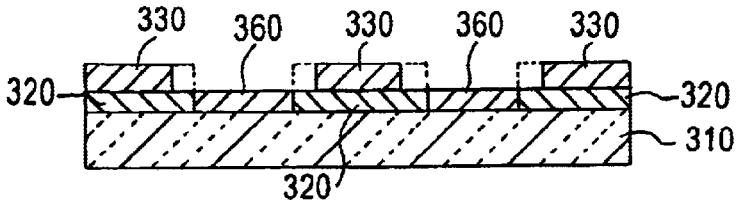
Figure 6F:
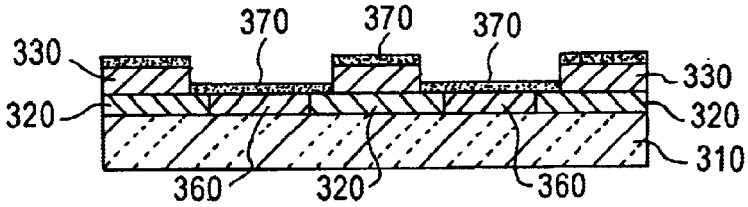
Figure 6G:
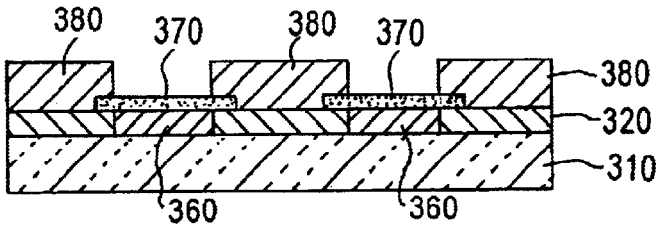
Figure 6H:
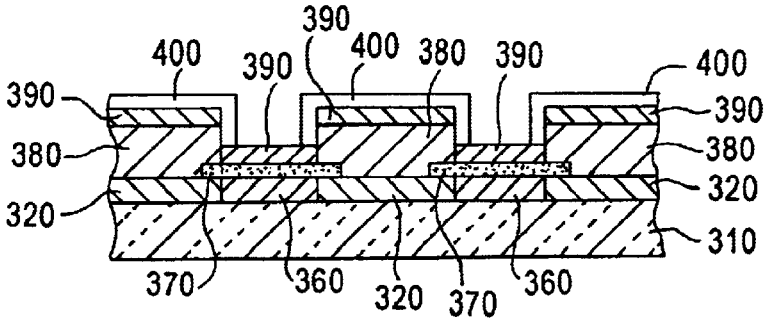
Figure 6I:
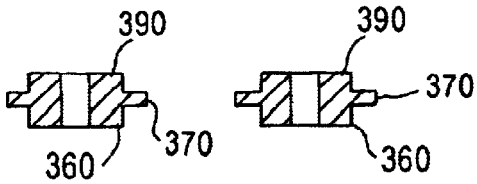

Referring now to FIGS. 6*a*–6*i*, another method of manufacturing field emitters according to the present invention is depicted. In FIG. 6*a*, a three-layer film of selective etching films 320, 330 and 340 is deposited on a substrate 310. The film 320 is deposited on an upper surface of the substrate 310. The film 330 is deposited on an upper surface of the film 320. The film 340 is deposited on an upper surface of the film 330. As shown in FIG. 6*b*, a protective mask 350 is formed on the created structure and ion etching of films 340, 330 and 320 is performed down to the substrate 310 as represented in FIG. 6*c*. The mask 350 includes three horizontally spaced apart stacks of films. In FIG. 6*d*, a film 360 made of the same material, as operating film 370 (FIG. 6*f*) is deposited on upper horizontal surfaces. Thus, film 360 is deposited on upper surfaces on the film 350 and the exposed substrate 310. In FIG. 6*e*, partial etching of the film 330 is carried out and films 340, 350, 360 are removed from above the film 330. In FIG. 6*f*, the operating film of the field emitter 370 is deposited on an upper surface of the remaining structure. Then, as depicted in FIG. 6*g*, the films 330 and the portion of the film 370 above the film 330 are removed and layer 380 is sputtered directly above the film 320 onto upper surfaces of films 370 and 320. The film 330 remaining above the film 320 is not co-extensive therewith leaving portions of upper surfaces of the film 320 exposed. A thicker film 390, made of the same material as operating film 370, is deposited as shown in FIG. 6*h* onto the upper surfaces of films 370 and 380. In FIG. 6*h*, a protective mask of chromium 400 is deposited on the obtained structure. As depicted in FIGS. 6*h* and 6*i*, holes are made by plasma-chemical etching through layers 390, 370, 360. After that the films 310, 320, and 380 are removed chemically in a selective etcher along with the protective film. The ready field emitter (shown in FIG. 6*i*) is a multi-layer structure. The materials used in the FIG. 6 embodiment may be as follows: film 310 is molybdenum, film 320 is vanadium, film 330 is aluminum, film 340 is copper, film 350 is chromium, film 360 is tantalum, film 370 is tantalum, film 380 is vanadium, film 390 is tantalum, and film 400 is chromium.

Other designs of field emitters may be produced in accordance with the present invention by changing the number of deposited films. Of course, although both described methods produced three field emitters, any number of field emitters can be produced on a substrate.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A field emitter, comprising:

a central operating layer having a first edge and a second edge and a first surface and a second surface;

at least one first support layer on the first surface; and at least one second support layer on the second surface;

wherein the first edge and the second edge extend beyond the first support layer and the second support layer.

2. The field emitter of claim 1, wherein the central operating layer is tantalum, the at least one first support layer is vanadium and the second support layer is vanadium.

3. The field emitter of claim 1, wherein the at least one first support layer and the at least one second support layer are substantially co-extensive.

* * * * *